US011566493B2

(12) United States Patent
Li et al.

(10) Patent No.: US 11,566,493 B2
(45) Date of Patent: Jan. 31, 2023

(54) PHYSICAL CHARACTERIZATION DEVICE AND METHOD FOR SCALE MODEL OF NATURAL GAS HYDRATE RESERVOIR

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Zhaoyang Chen, Guangzhou (CN); Yi Wang, Guangzhou (CN); Zhiming Xia, Guangzhou (CN); Gang Li, Guangzhou (CN); Yu Zhang, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 286 days.

(21) Appl. No.: 16/973,784

(22) PCT Filed: Sep. 8, 2020

(86) PCT No.: PCT/CN2020/114087
§ 371 (c)(1),
(2) Date: Dec. 10, 2020

(87) PCT Pub. No.: WO2021/159696
PCT Pub. Date: Aug. 19, 2021

(65) Prior Publication Data

US 2022/0235632 A1 Jul. 28, 2022

(30) Foreign Application Priority Data

Aug. 6, 2020 (CN) ..... 202010783706.5

(51) Int. Cl.
*E21B 41/00* (2006.01)
*E21B 47/07* (2012.01)
*E21B 33/12* (2006.01)

(52) U.S. Cl.
CPC ..... *E21B 41/00* (2013.01); *E21B 33/12* (2013.01); *E21B 47/07* (2020.05)

(58) Field of Classification Search
CPC ..... E21B 41/00; E21B 33/12; E21B 47/07; E21B 41/0099; E21B 47/00; G01N 33/00; G01D 21/02
See application file for complete search history.

(56) References Cited

FOREIGN PATENT DOCUMENTS

CN 101550816 A * 10/2009
CN 101550816 A 10/2009
(Continued)

OTHER PUBLICATIONS

ISR PCT/CN2020/114087, 2020.*

*Primary Examiner* — Steven A MacDonald
(74) *Attorney, Agent, or Firm* — Bayramoglu Law Offices LLC

(57) ABSTRACT

A device and a method for physical characterization in a large-scale natural gas hydrate experimental system are provided. The device includes a reactor, horizontal wellbores, and vertical wellbores. The reactor includes an upper cover, a lower cover, and a reactor body, and the upper cover and the lower cover are sealably attached to two ends of the reactor to form a closed chamber. The physical characterization device further includes lateral vertical well assemblies and temperature-pressure-resistance assemblies, wherein the lateral vertical well assemblies and the temperature-pressure-resistance assemblies are disposed to penetrate the reactor from the upper cover to the lower cover. The physical characterization method is conducted using the
(Continued)

physical characterization device, including a step of producing contour plots using a data processing software with three-dimensional matrix data collected by the pressure measuring tubes, the temperature measuring tubes, and the resistivity measuring columns.

10 Claims, 5 Drawing Sheets

(56) References Cited

FOREIGN PATENT DOCUMENTS

| | | | | | |
|---|---|---|---|---|---|
| CN | 202220587 | U | | 5/2012 | |
| CN | 109236243 | A | | 1/2019 | |
| CN | 109236244 | A | * | 1/2019 | ..... E21B 43/01 |
| CN | 109236244 | A | | 1/2019 | |
| CN | 109611059 | A | | 4/2019 | |
| KR | 20130125186 | A | | 11/2013 | |
| RU | 2705707 | C1 | | 11/2019 | |

* cited by examiner

PHYSICAL CHARACTERIZATION DEVICE AND METHOD FOR SCALE MODEL OF NATURAL GAS HYDRATE RESERVOIR

CROSS REFERENCE TO THE RELATED APPLICATIONS

This application is the national stage entry of International Application No. PCT/CN2020/114087, filed on Sep. 8, 2020, which is based upon and claims priority to Chinese Patent Application No. 202010783706.5, filed on Aug. 6, 2020, the entire contents of which are incorporated herein by reference.

TECHNICAL FIELD

The present invention relates to the technical field of physical characterization for experimental system, and particularly relates to a device and a method for physical characterization for a scale model of natural gas hydrate reservoir.

BACKGROUND

As scientific research goes deeper, it will develop from a single-disciplinary form to an interdisciplinary and integrated form. Demands on experimental devices for natural gas hydrate simulation have also been developed from single-function designs to integration and systematization. Investigations shows that, existing experimental devices for natural gas hydrate simulation are capable of not only simulating the phase behavior of hydrates, but also simulating hydrate sediments, determining various physical and chemical properties of stratum with or without hydrate formation, and studying geological parameters of hydrate formation.

Currently, physical characterization in a large-scale experimental system only involves the characterization of temperature or any single parameter, which is insufficient for a complete study of the temperature, pressure and phase state in a large-scale hydrate simulation reactor or for a real-time and in-situ characterization of heat transfer, mass transfer and hydrate phase change during the exploitation of hydrates.

SUMMARY

In view of the above defects in prior art, the present invention provides a device and a method for physical characterization in a large-scale natural gas hydrate experimental system, which allow the complete study of the temperature, pressure and phase state in a large-scale hydrate simulation reactor and the real-time and in-situ characterization of heat transfer, mass transfer and hydrate phase change during the exploitation of hydrates.

In order to realize the above object, the present invention comprises the following technical solutions:

A physical characterization device for a large-scale natural gas hydrate experimental system, comprises a reactor, horizontal wellbores, and vertical wellbores; the reactor comprises an upper cover, a lower cover, and a reactor body; the upper cover and the lower cover are sealably attached to two ends of the reactor to form a closed chamber, wherein the chamber is filled with porous medium and liquid, and the porous medium and the liquid is configured to simulate a geologically layered structure of hydrate reservoir; the physical characterization device further comprises lateral vertical well assemblies and temperature-pressure-resistance assemblies, wherein the lateral vertical well assemblies and the temperature-pressure-resistance assemblies are disposed to penetrate the reactor from the upper cover to the lower cover;

each of the lateral vertical well assemblies and the temperature-pressure-resistance assemblies comprises a mounting pipe, a sealing plug, a lock nut, resistivity measuring columns, pressure measuring tubes, and temperature measuring tubes; the mounting pipe is connected to the upper cover; the sealing plug is sealingly inserted into a top end of the mounting pipe and secured by the lock nut; the resistivity measuring columns, the pressure measuring tubes, and the temperature measuring tubes are disposed in parallel to each other to penetrate the sealing plug and extend along an axial direction of the mounting pipe; a pressure probe is provided at a bottom end of each of the pressure measuring tubes and a temperature probe is provided at a bottom end of each of the temperature measuring tubes; each of the lateral vertical well assemblies is further provided with the vertical wellbores, wherein the vertical wellbores are disposed in parallel to the resistivity measuring columns, the pressure measuring tubes, and the temperature measuring tubes, and a sand screen is provided at a bottom end of each of the vertical wellbores; the horizontal wellbores are inserted into the reactor in a direction perpendicular to the vertical wellbores; the lateral vertical well assemblies and the temperature-pressure-resistance assemblies are configured to collect temperature data, pressure data, and resistivity data for characterizing the geologically layered structure of hydrate reservoir in the reactor.

The physical characterization device as described above is further characterized that, a resistivity measuring column support is provided inside each of the lateral vertical well assemblies, wherein an upper end of the resistivity measuring column support is fixed to the sealing plug; a plurality of clips are provided on the resistivity measuring column support along an axial direction of the resistivity measuring column support, and configured to secure the resistivity measuring column.

The physical characterization device as described above is further characterized that, the lateral vertical well assemblies and the temperature-pressure-resistance assemblies are disposed in a 9×9 matrix array, wherein the lateral vertical well assemblies are disposed in three rows in the matrix array, three lateral vertical well assemblies are disposed at regular intervals in each row, and two temperature-pressure-resistance assemblies are disposed at regular intervals between each two lateral vertical well assemblies.

The physical characterization device as described above is further characterized that, each of the lateral vertical well assemblies and the temperature-pressure-resistance assemblies comprises five resistivity measuring columns, five pressure measuring tubes, and five temperature measuring tubes; the matrix array is a 900 mm×900 mm rectangular plane centered on an axis of the reactor, and a distance between each two adjacent assemblies is 150 mm.

The physical characterization device as described above is further characterized that, each of the pressure measuring tubes is sprayed with a thermally and electrically insulating coating and subjected to surface roughening, in order to prevent gas-liquid crossflow along the reactor wall, heat loss, and interference with the measurement using electrical resistance tomography; each of the temperature measuring tubes is a stainless steel tube and subjected to surface roughening, in order to prevent gas-liquid crossflow along the reactor wall, heat loss, and temperature loss.

The physical characterization device as described above is further characterized that, the vertical wellbore located at the center of the reactor is a central vertical wellbore, while the remaining vertical wellbores are non-central vertical wellbores, wherein the pressure sensors of the pressure measuring tubes in the central vertical wellbore are central vertical well pressure sensors, and the pressure sensors of the pressure measuring tubes in the non-central vertical wellbores are non-central vertical well pressure sensors; the physical characterization device further comprises non-central vertical well outlet valves, communicating vessel valves, differential pressure sensors, a communicating vessel, and a central vertical well outlet valve; wherein the non-central vertical well pressure sensors, the non-central vertical well outlet valves, the differential pressure sensors, and the communicating vessel valves are respectively provided in an amount identical to that of the non-central vertical wellbores; each of the non-central vertical wellbores is provided with a non-central vertical well outlet pipeline, wherein each non-central vertical well outlet pipeline is correspondingly provided with one of the non-central vertical well pressure sensors, one of the non-central vertical well outlet valves, one of the differential pressure sensors, and one of the communicating vessel valves communicatedly in sequence, and all of the communicating vessel valves are connected with the communicating vessel;

the central vertical wellbore is provided with a central vertical well outlet pipeline, wherein the central vertical well outlet pipeline is provided with the central vertical well pressure sensors and the central vertical well outlet valve communicatedly in sequence, and the central vertical well outlet valve is connected with the communicating vessel.

The physical characterization device as described above is further characterized that, the differential pressure sensors and the communicating vessel are disposed outside the reactor; the differential pressure sensors have a measuring accuracy higher than that of the central vertical well pressure sensors and the non-central vertical well pressure sensors, and a measuring range lower than that of the central vertical well pressure sensors and the non-central vertical well pressure sensors.

A physical characterization method for a large-scale natural gas hydrate experimental system, using any one physical characterization device as described above, comprises the following steps:

dividing sediment in the chamber of the reactor into a plurality of layers;

arranging the lateral vertical well assemblies and the temperature-pressure-resistance assemblies in the matrix array, and inserting the lateral vertical well assemblies and the temperature-pressure-resistance assemblies longitudinally into the reactor;

producing contour plots using a data processing software with three-dimensional matrix data collected by the pressure measuring tubes, the temperature measuring tubes, and the resistivity measuring columns, for real-time inspecting a temperature field, a pressure field, and a resistivity filed in the reactor, and thereby simulating a hydrate distribution field, the pressure field, and the temperature field in the reactor.

The physical characterization method as described above is further characterized that, the chamber of the reactor is a cylinder with a height of 1680 mm and a diameter of 1400 mm, and the sediment in the chamber is divided into five layers, respectively with a distance of 160 mm, 500 mm, 840 mm, 1180 mm, and 1520 mm from a top of the reservoir.

The physical characterization method as described above is further characterized that, the matrix array is a 900 mm×900 mm rectangular plane centered on an axis of the reactor, and a distance between each two adjacent assemblies is 150 mm.

Compared with the prior art, the present invention has the following beneficial effects: Inside the lateral vertical well assemblies and the temperature-pressure-resistance assemblies are provided with the temperature sensors, pressure sensors, and resistivity sensors, which enable spatial matrix distributed measurements. The temperature field and the pressure field are respectively obtained by distributing the temperature sensors and pressure sensors in a spatial matrix, and the hydrate distribution field is obtained by measuring the change of hydrate saturation using electrical resistance tomography (ERT), which enable the real-time and in-situ characterization of heat transfer, mass transfer, multiphase flow, and hydrate phase change during the exploitation of hydrates, and thereby realize multi-mode, multi-scale, in-situ and precise characterization and measurement of key parameters in a hydrate exploitation.

Figure 1:
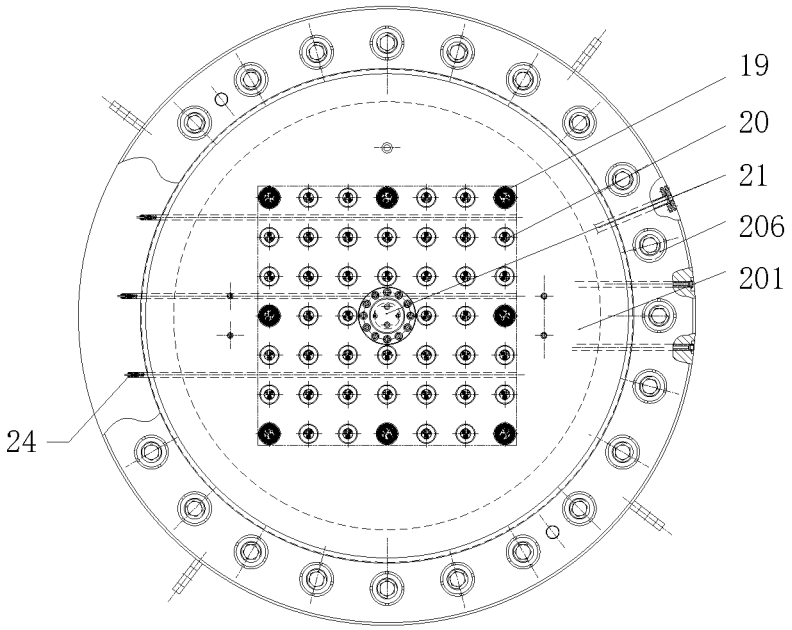
FIG. 1 shows the structure of a physical characterization device of the present invention.

Reference signs: 1—wire connector; 2—lock nut; 3—sealing plug; 4—rubber O-ring; 5—resistivity measuring column; 6—pressure measuring tube; 7—temperature measuring tube; 8—vertical wellbore; 9—circlip; 10—fixed end of resistivity measuring column support; 11—mounting pipe; 12—part of a reactor cover; 13—resistivity measuring column support; 14—clip of resistivity measuring column support; 15—temperature-pressure measuring tube; 17—sand screen; 18—temperature-pressure probe; 19—lateral vertical well assembly; 20—temperature-pressure-resistance assembly; 21—exploitation-simulating central well; 24—horizontal wellbore;

200—reactor body; 201—upper cover; 202—lower cover; 203—upper circulation coil; 204—lower circulation coil; 2—temperature control pipe; 206—bolt;

301—central vertical well outlet pipeline; 302—central vertical well pressure sensor; 303—central vertical well outlet valve; 304—communicating vessel; 305—non-central vertical well outlet pipeline; 306—non-central vertical well pressure sensor; 307—non-central vertical well outlet valve; 308—differential pressure sensor; 309—communicating vessel valve; 310—communicating vessel pressure sensor; 311—gas injection valve.

DETAILED DESCRIPTION OF THE EMBODIMENTS

The present invention will be further described in detail below with the accompanying drawings and embodiments.

Embodiments

As shown in FIG. 1 to FIG. 4 is a physical characterization device for a large-scale natural gas hydrate experimental system, comprises a reactor, horizontal wellbores 24, and vertical wellbores 8, wherein the reactor comprises an upper cover, a lower cover, and a reactor body. An overlying pressure layer, a superstratum layer, a hydrate layer and a substratum layer are sequentially formed throughout the inside of the chamber from the upper cover to the lower cover, wherein, the pressure layer is configured to simulate deep sea pressure, and each layer is filled with different kinds of porous medium and liquid to simulate a geologically layered structure of hydrate reservoir; but of course, some embodiments only include the superstratum layer, the hydrate layer and the substratum layer. Depending on the needs, the exploitation method can be selected from the depressurization method and the thermal stimulation method, wherein the depressurization method is one of the currently major methods for hydrate exploitation, which involves a dissociation process of hydrate solids to produce methane gas, caused by reducing the pressure on the gas hydrate layer to lower than the phase equilibrium pressure of hydrate under the local temperature. Design of exploitation wells for the depressurization method is similar to those for conventional exploitation of oil and gas; the pressure spreads quickly in the hydrate reservoir with higher permeability, and thus the depressurization method is the most potential method which is economical and effective. The thermal stimulation method refers to a process of heating the gas hydrate layer to raise its temperature to above the equilibrium temperature, which causes the gas hydrate to dissociate into water and natural gas.

Reference is made to FIG. 1, which shows that the upper cover and the lower cover are sealably attached to two ends of the reactor through fixing bolts 22 to form a closed chamber. The upper cover comprises a 900 mm×900 mm rectangular plane centered on an axis of the reactor (wherein an exploitation-simulating central well 21 is located at the center of the rectangular plane). The lateral vertical well assemblies 19 and the temperature-pressure-resistance assemblies 20 are disposed over a 900 mm×900 mm rectangular plane centered on the axis of the reactor with a distance of 150 mm between each two adjacent assemblies, and penetrate the reactor from the upper cover to the lower cover. The chamber of the reactor is a cylinder with a height of 1680 mm and a diameter of 1400 mm, and the sediment in the chamber is divided into five layers, respectively with a distance of 160 mm (the superstratum layer), 500 mm, 840 mm, 1180 mm (the hydrate layers), and 1520 mm (the substratum layer) from a top of the reservoir.

Figure 2:
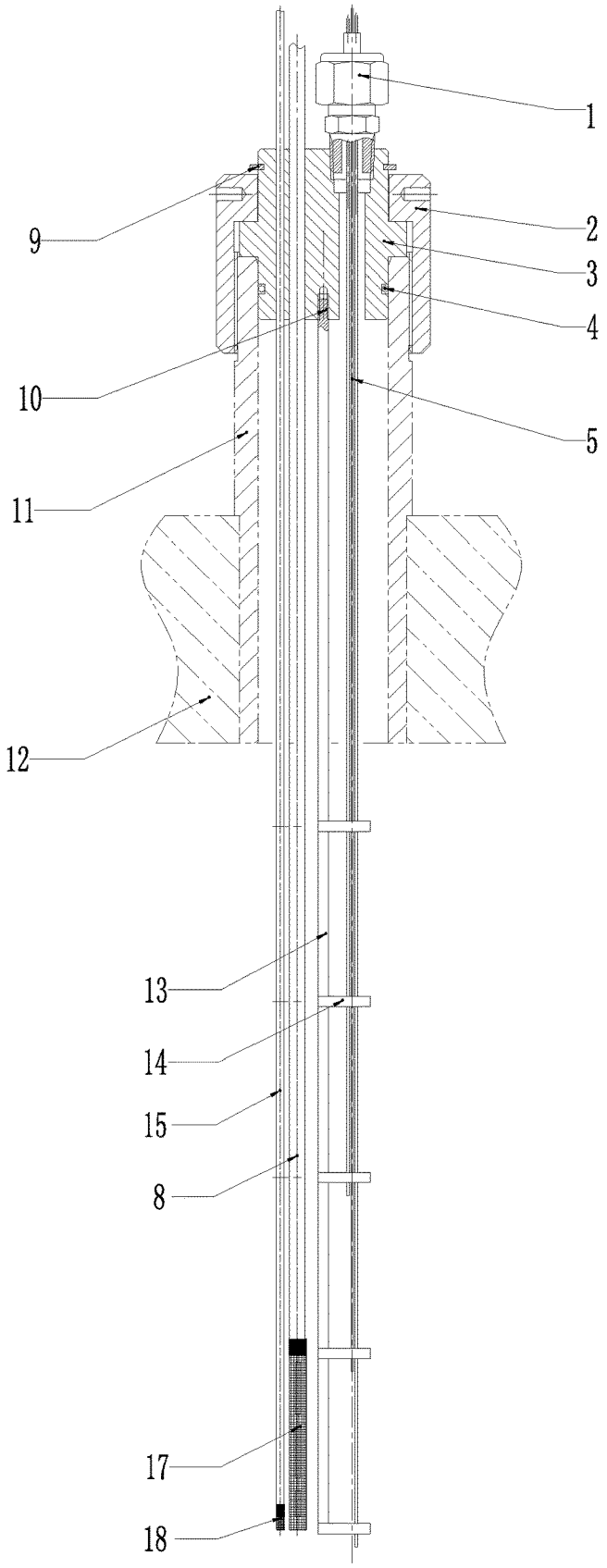
FIG. 2 shows the structure of a lateral vertical well assembly of the present invention.
Figure 3:
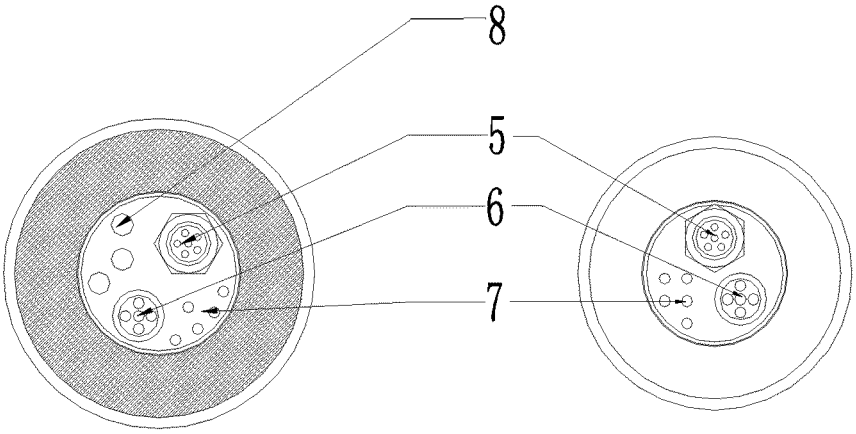
FIG. 3 is a sectional view of the lateral vertical well assembly and the temperature-pressure-resistance assembly.

Reference is further made to FIG. 2 and FIG. 3 which show that each of the lateral vertical well assemblies 19 and the temperature-pressure-resistance assemblies 20 comprises a mounting pipe 11, a sealing plug 3, a lock nut 2, resistivity measuring columns 5, pressure measuring tubes 6, and temperature measuring tubes 7. The mounting pipe 11 is connected to part 12 of the reactor cover. The sealing plug 3 is sealingly inserted into a top end of the mounting pipe 11 and secured by the lock nut 2, wherein the sealing plug 3 is provided with a rubber O-ring 4 where it contacts the internal wall of the mounting pipe 11, and further provided with a circlip 9 above the lock nut 2. The resistivity measuring columns 5, the pressure measuring tubes 6, and the temperature measuring tubes 7 are disposed in parallel to each other to penetrate the sealing plug 3 and extend along an axial direction of the mounting pipe 11. A pressure probe is provided at a bottom end of each of the pressure measuring tubes 6 and a temperature probe is provided at a bottom end of each of the temperature measuring tube 7. Each of the lateral vertical well assemblies 19 is further provided with three vertical wellbores 8, which have different lengths and are respectively inserted to different hydrate layers. The vertical wellbores 8 are disposed in parallel to the resistivity measuring columns 5, the pressure measuring tubes 6, and the temperature measuring tubes 7, and a sand screen 17 is provided at a bottom end of each of the vertical wellbores 8. An upper end of each of the resistivity measuring columns 5 protrudes through a wire connector 1. A resistivity measuring column support 13 is provided inside each of the lateral vertical well assemblies 19, wherein an upper end of the resistivity measuring column support 13 is fixed to the sealing plug through a fixed end 10 of resistivity measuring column support. A plurality of clips 14 are provided on the resistivity measuring column support 13 along an axial direction of the resistivity measuring column support, and configured to secure the resistivity measuring column 5. The measuring tubes may be the pressure measuring tubes 6 and the temperature measuring tubes 7, though FIG. 2 schematically shows a temperature-pressure measuring tube 15 and a temperature-pressure probe 18.

Each of the lateral vertical well assemblies 19 and the temperature-pressure-resistance assemblies 20 comprises five resistivity measuring columns 5, five pressure measuring tubes 6, and five temperature measuring tubes 7.

The pressure measuring tubes 6, constructed as a tube assembly, are longitudinally (perpendicularly) inserted into the five sediment layers having a distance of 160 mm, 500 mm, 840 mm, 1180 mm, and 1520 mm from the top of the reservoir. Totally forty-nine assemblies are disposed at the cover. In the five-layered matrix distribution, there are totally two hundred and forty-five (49×5=245) pressure sensors. Each of the pressure measuring tubes 6 comprises five pressure measuring sub-tubes. The five pressure measuring sub-tubes are integratedly inserted into a sealing sleeve and then subjected to silver soldering to form a pressure measuring tube 6. Each pressure measuring sub-tube of the pressure measuring tube 6 is sprayed with a thermally and electrically insulating coating and subjected to surface roughening, in order to prevent gas-liquid crossflow along the wall, heat loss, and interference with the electrical resistance tomography measurement. Each pressure measuring sub-tube has a diameter of 3 mm, and is provided at its end with four grooves (3×1, mm), which are cover by a silver or tin soldered screen for preventing sands from entering and blocking the pressure measuring tube 6.

The temperature measuring tubes 7, constructed as an integrated package, are longitudinally inserted into the five sediment layers having a distance of 160 mm, 500 mm, 840 mm, 1180 mm, and 1520 mm from the top of the reservoir. Totally forty-nine assemblies are disposed at the cover. In the five-layered matrix distribution, there are totally two hundred and forty-five (49×5=245) temperature sensors. Each of the temperature measuring tubes 7 comprises five temperature measuring sub-tubes; the temperature sensors are integrated in a package, wherein five PT100A platinum resistors are placed into one 14 mm pressure-resistant closed stainless steel tube, each of the platinum resistors is inserted to a specific depth defined by a positioning clip, and thereby the temperature of each point of the medium can be measured. The pressure-resistant closed stainless steel tube (the temperature sensor tube) is subjected to surface roughening, in order to prevent gas-liquid crossflow along the wall, heat loss, and temperature loss, which affect the accuracy of temperature measurement.

The resistivity measuring columns 5, constructed as a PEEK armored form, are longitudinally inserted into the five sediment layers having a distance of 160 mm, 500 mm, 840 mm, 1180 mm, and 1520 mm from the top of the reservoir.

Each of the lateral vertical well assemblies 19 and the temperature-pressure-resistance assemblies 20 comprises a mounting pipe 11, a sealing plug 3, a lock nut 2, resistivity measuring columns 5, pressure measuring tubes 6, and temperature measuring tubes 7. The mounting pipe 11 is connected to the upper cover. The sealing plug 3 is sealingly inserted into a top end of the mounting pipe 11 and secured by the lock nut 2. The resistivity measuring columns 5, the pressure measuring tubes 6, and the temperature measuring tubes 7 are disposed in parallel to each other to penetrate the sealing plug 3 and extend along an axial direction of the mounting pipe 11. A pressure probe is provided at a bottom end of each of the pressure measuring tubes 6 and a temperature probe is provided at a bottom end of each of the temperature measuring tubes 7. Each of the lateral vertical well assemblies 19 is further provided with the vertical wellbores 8, wherein the vertical wellbores 8 are disposed in parallel to the resistivity measuring columns 5, the pressure measuring tubes 6, and the temperature measuring tubes 7, and a sand screen 17 is provided at a bottom end of each of the vertical wellbores 8. The horizontal wellbores 24 are inserted into the reactor in a direction perpendicular to the vertical wellbores 8.

A resistivity measuring column support is provided inside each of the lateral vertical well assemblies 19, wherein an upper end of the resistivity measuring column support is fixed to the sealing plug 3; a plurality of clips are provided on the resistivity measuring column support along an axial direction of the resistivity measuring column support, and configured to secure the resistivity measuring column.

The lateral vertical well assemblies 19 and the temperature-pressure-resistance assemblies 20 are disposed in a matrix array, wherein three lateral vertical well assemblies 19 are disposed at regular intervals along each side of the matrix array, and two temperature-pressure-resistance assemblies 20 are disposed at regular intervals between each two lateral vertical well assemblies 19. Inside the matrix are provided with temperature-pressure-resistance assemblies 20 corresponding to the lateral vertical well assemblies 19 and temperature-pressure-resistance assemblies 20 at each side. The resistivity measuring columns 5 are constructed as a PEEK armored form, wherein five silver-plated copper wires loop around a rod to form five ring-shaped measuring electrodes, and the distance between adjacent ring-shaped electrodes is 340 mm. By connecting two adjacent ring-shaped electrodes to form a circuit, it is possible to measure the resistance of the medium between the ring-shaped electrodes and thereby calculate the resistivity of the medium therebetween. Each resistivity measuring column tightly contacts with a sealing sleeve using PEEK ferrules and secured using a lock nut 2. PEEK is an excellent sealing material with reliable sealing performance. The sealing sleeve tightly contacts with the mounting pipe 11 using an O-ring and secured using a lock nut 2. The resistivity measuring columns are subjected to surface roughening, in order to prevent gas-liquid crossflow along the wall, How the device works in the present embodiment: The resistivity measuring columns 5, the pressure measuring tubes 6, and the temperature measuring tubes 7 are disposed for simulating a distribution field, a pressure field, and a temperature field of hydrates in the reactor. The temperature field and the pressure field are respectively obtained by distributing the temperature sensors and pressure sensors in a spatial matrix, and the hydrate distribution field is obtained by measuring the change of hydrate saturation using electrical resistance tomography (ERT), which enable the real-time and in-situ characterization of heat transfer, mass transfer, multiphase flow, and hydrate phase change during the exploitation of hydrates, and thereby realize multi-mode, multi-scale, in-situ and precise characterization and measurement of key parameters in a hydrate exploitation.

Figure 5:
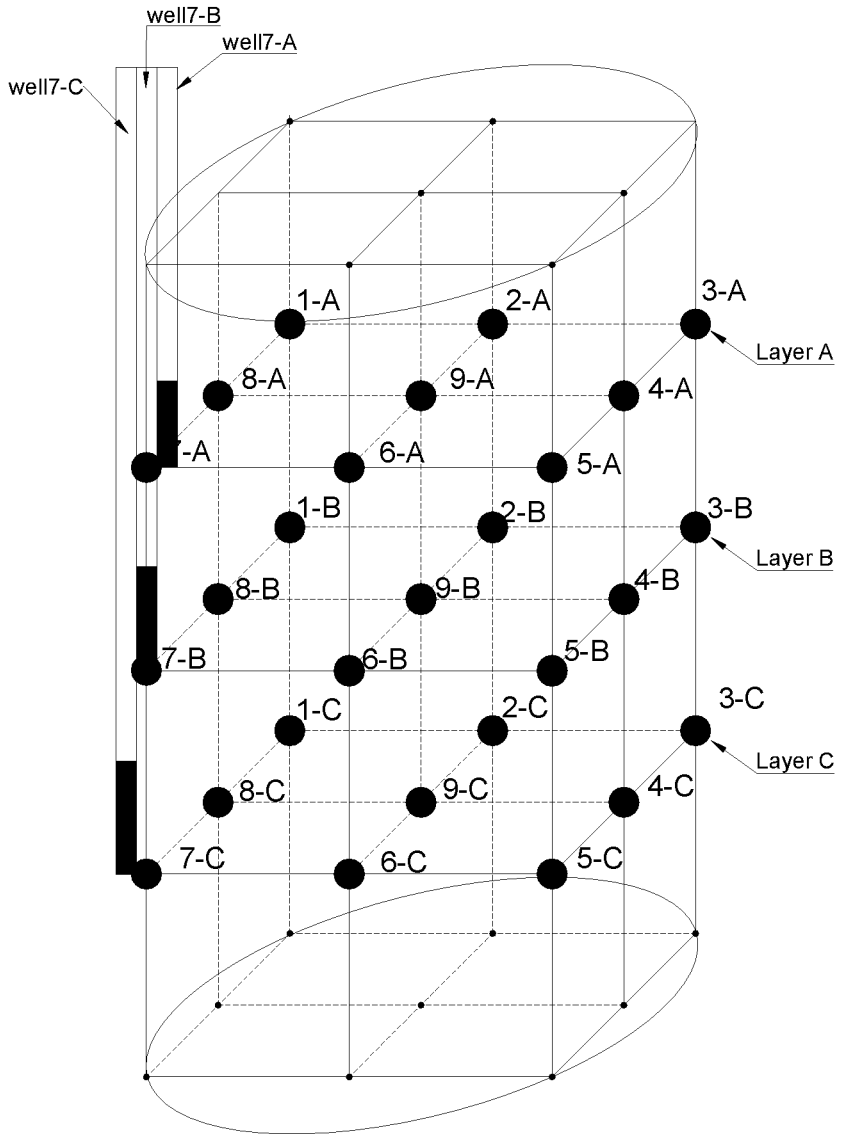
FIG. 5 shows the arrangement of sensors and wellbores in one embodiment of the present invention.
Figure 6:
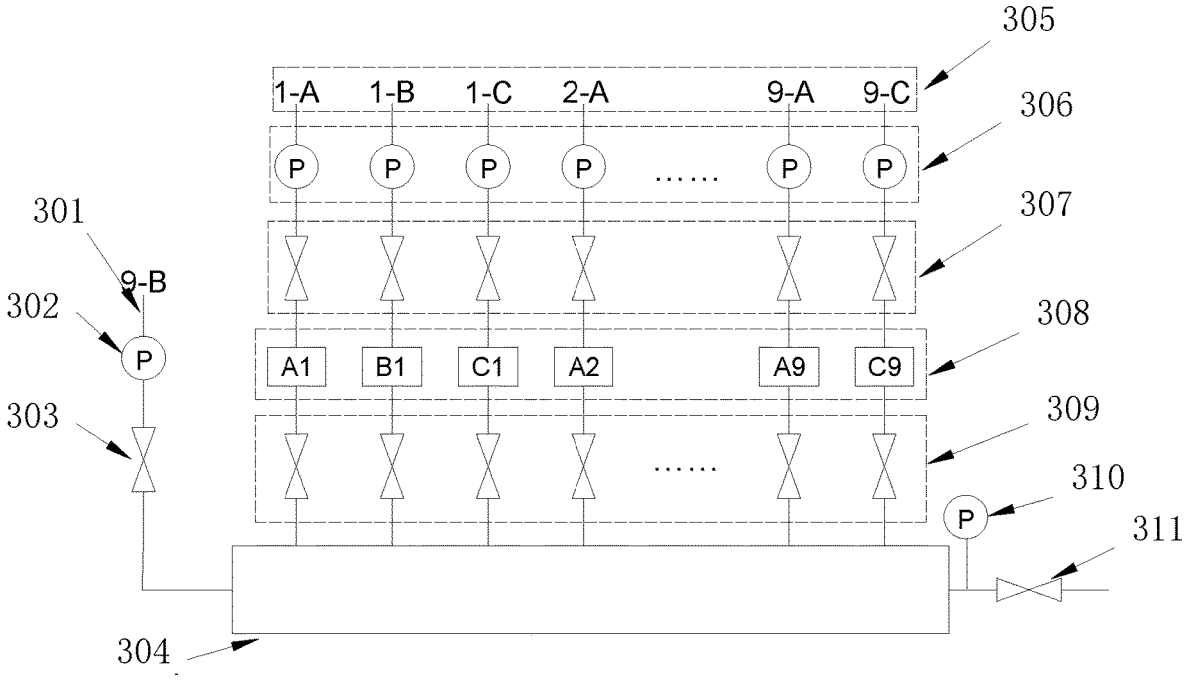
FIG. 6 shows the structure of the present invention for a flow field measurement in one embodiment.

In addition, the physical characterization device of the present invention is capable of charactering the flow field in the reactor. Reference is made to FIG. 5, which shows that, there are twenty-seven vertical wells (i.e. the vertical wellbores described in the above embodiment) provided in the reactor of the physical characterization device in the present embodiment. The natural gas hydrate reservoir is divided into three layers, wherein nine vertical wells are symmetrically distributed throughout each layer. The wells are respectively numbered as 1-A, 2-A, . . . , 9-B, and 9-C, wherein the vertical well 9-B located at center is a central vertical well, while the remaining vertical wells are non-central vertical wells. As shown in FIG. 6, the measurement device provided in the present embodiment mainly comprises non-central vertical well pressure sensors 306, non-central vertical well outlet valves 307, communicating vessel valves 309, differential pressure sensors 308, a communicating vessel 304, a central vertical well outlet valve 303, and a central vertical well pressure sensor 302.

The non-central vertical well pressure sensors 306, the non-central vertical well outlet valves 307, the differential pressure sensors 308, and the communicating vessel valves 309 are respectively provided in an amount identical to that of the non-central vertical wells. All non-central vertical well outlet pipelines 305, except for the vertical well 9-B, are respectively connected to a non-central vertical well pressure sensor 306, a non-central vertical well outlet valve 307, and one end of a differential pressure sensor 308 in sequence. The other end of the differential pressure sensor 308 is connected to a communicating vessel valve 309. All of the communicating vessel valves 309 are connected with the communicating vessel 304. The other end of the communicating vessel 304 is connected to the central vertical well outlet valve 303, the central vertical well pressure sensor 302, and a central vertical well outlet pipeline 301.

The twenty-six differential pressure sensors are respectively numbered as A1, B1, C1, A2, . . . , A9, and C9, representing the differential pressure sensor connecting the well 1-A and well 9-B, the differential pressure sensor connecting the well 1-B and well 9-B, . . . , the differential pressure sensor connecting the well 9-A and well 9-B, and the differential pressure sensor connecting the well 9-C and well 9-B. Specifically, the differential pressure sensors 308 have a measuring accuracy higher than that of the central vertical well pressure sensor 302 and non-central vertical well pressure sensors 306, and a measuring range lower than that of the central vertical well pressure sensor 302 and non-central vertical well pressure sensors 306. Since the pressure sensors are not applicable for low pressure differences due to their low measuring accuracy while the differential pressure sensors 308 have a higher measuring accuracy, when the pressure difference is relatively low, the pressure sensors may show the same readings while the differential pressure sensors is capable of revealing the pressure difference; when the pressure difference is relatively high and exceed the measuring range of the differential pressure sensors, the differential pressure sensors may be damaged. In summary, the differential pressure sensors have a high accuracy but a low measuring range, while the pressure sensors have a high measuring range but a low accuracy, and thus these two kinds of sensors should be used in combination.

Accordingly, when it is necessary to inspect a flow field in the reactor, the first step is recording readings of the twenty-seven pressure sensors to obtain a pressure difference between each vertical well and the central vertical well, and then comparing the obtained pressure difference with a measuring range of the differential pressure sensor; if the obtained pressure difference is higher than the measuring range of the differential pressure sensor, then the obtained pressure difference is determined to be a pressure difference between the non-central vertical well corresponding to the differential pressure sensor and the central vertical well; if the obtained pressure difference is not higher than the measuring range of the differential pressure sensor, then opening the non-central vertical well outlet valve and the communicating vessel valve which are connected to the differential pressure sensor, and measuring the pressure difference between the corresponding non-central vertical well and the central vertical well using the differential pressure sensor. Driven by the pressure differences, gas and liquid will flow spontaneously from a high pressure zone to a low pressure zone (or tend to flow spontaneously from the high pressure zone to the low pressure zone), in other words, the accurate measurement of flow field in the reactor is realized.

In view of the above, with the characterization device, the flow field inside the reactor is quantified according to the pressure differences between the points, accurately and effectively. Providing differential pressure sensors, between a measuring point of the central vertical well and a measuring point of each of the non-central vertical wells, to measure the pressure differences, enables reasonable distribution of three-dimensional space inside the entire reactor, making it easier to analyze the gas-liquid flow trends in the reactor with the simulated flow field. The step of determining whether to turn on the differential pressure sensors according to a predetermination based on the feedback from the pressure sensors, allows flow field measurements in the reactor under both high and low pressure differences and effective protection of the differential pressure sensors. Meanwhile, since communication of the entire measurement device is realized by the vertical well outlet pipelines, the measurement device can be externally connected to the reactor, in other words, the differential pressure sensors and the communicating vessel can be disposed outside the reactor. Thus, it is not necessary to conduct significant modifications to the entire gas hydrate system, and no damage will be done to the experimental devices; for a natural gas hydrate experimental system without characterization function, it is possible to introduce the present device whenever it is required.

In addition, since currently existing natural gas hydrate experimental devices are constructed, as compared with actual formation environment, in a scale not enough to present a temperature gradient, most reactors are configured to be disposed in a constant temperature water bath. However, in actual exploitation, natural gas hydrate reservoirs are affected by the temperature of the formation, and there will be certain temperature differences and temperature gradient as the temperature changes with depth. The temperature gradient will have a certain impact on the formation and exploitation of natural gas hydrates, resulting in a higher requirement, for simulating the formation temperature gradient, on large-scale natural gas hydrate devices which operate in a situation closer to the actual exploitation; how to accurately regulate the temperature gradient to realize the in-situ temperature field simulation of NGH reservoir is a technical problem to be solved at present.

Figure 4:
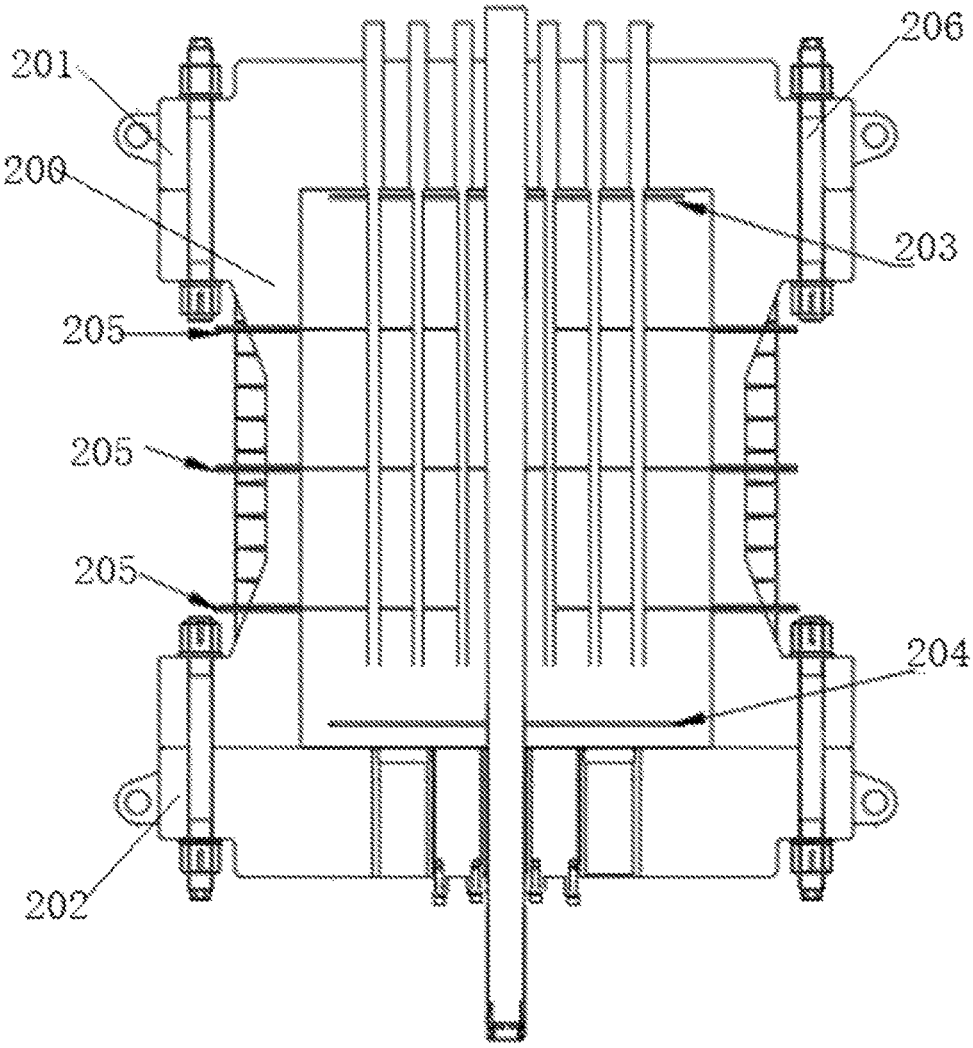
FIG. 4 shows the internal structure of a reactor.

Accordingly, as shown in FIG. 4, the reactor comprises a reactor body 200, an upper cover 201 disposed at an upper surface of the reactor body, and a lower cover 202 disposed at a lower surface of the reactor body. The connection between the reactor body 200 and the upper and lower covers are realized by means of bolts 206, such that the connection is stable, firm, safe and reliable.

An upper circulation coil 203 and a lower circulation coil 204 are respectively disposed at an upper end and a lower end inside the reactor body 200. The upper circulation coil 203 and the lower circulation coil 204 are respectively provided with an independent heat exchange device (not shown in the drawing) to realize the circulation of the heat transfer medium in the coils. The heat exchange devices are capable of cooling, heating, and maintaining temperature. With the upper circulation coil 203 and the lower circulation coil 204, isothermal planes are formed at the upper end and the lower end inside the reactor body 200. However, with the isothermal planes formed at the upper end and the lower end inside the reactor body only, since heat insulation at the periphery of the reactor is not realized, under the influence of thermal convection, the temperature will be high throughout most of the space from bottom to top, making it impossible to form a balanced temperature gradient, and therefore failing to simulate the temperature gradient throughout the formation. Accordingly, in the present embodiment, N temperature control pipes 205 are spacedly provided inside the reactor body 200 and between the upper circulation coil 203 and the lower circulation coil 204, configured to form a vertical temperature gradient in the reactor body 200, wherein N is a positive integer and determined depending on actual requirement. In the present invention, N is 3, i.e., three temperature control pipes 205 are provided, and each temperature control pipe 205 is also provided with an independent heat exchange device to realize the circulation of the heat transfer medium in the temperature control pipe.

The configuration of providing the upper circulation coil and the lower circulation coil at the upper and lower ends inside the reactor body realizes stable heating. N temperature control pipes are spacedly provided between the upper circulation coil and the lower circulation coil and encircling the reactor body; moreover, each temperature control pipe is also provided with an independent heat exchange device to realize the circulation of the heat transfer medium in the temperature control pipe (i.e., they are also capable of cooling, heating, and maintaining temperature), such that the temperature of each temperature control pipe can be regulated independently, realizing the simulation of formation temperature gradient inside the reactor body.

In addition, since the formation temperature gradually decreases at a certain gradient from bottom to top, in order to realize a more precise simulation of formation temperature gradient, the N temperature control pipes are equally spaced from bottom to top and a constant temperature difference is given between the temperature control pipes; such configuration the arrangement of low temperature zone to high temperature zone at intervals of the same temperature difference and distance from top to bottom. Specifically, the lower circulation coil 204 is set to produce a high temperature T1, while the upper circulation coil 203 is set to produce a low temperature T2; N temperature control pipes 205 are provided, wherein the temperature difference between the temperature control pipes 205 can be expressed as $\Delta T=(T1-T2)/(N+1)$, i.e., the temperature control pipes 205 from top to bottom are respectively set to produce a temperature of $T2+\Delta T$, $T2+2\Delta T$, . . . , and $T2+N\Delta T$.

Moreover, in order to maintain the temperature difference $\Delta T$ between the temperature control pipes stable in real time so as to achieve the most realistic simulation of the formation, temperature sensors are provided inside the reactor body 200, configured to monitor the temperatures of the upper circulation coil 203, the lower circulation coil 204 and the N temperature control pipes 205 and transmit the monitored temperature data to a temperature regulator. The temperature regulator regulates in real time the operation of each heat exchange device according to the monitored temperature data, so as to maintain the vertical temperature gradient in the reactor body stable. Specifically in the present embodiment, the temperature difference for the vertical temperature gradient is set to be 5° C., and the temperature control accuracy is ±0.5° C.

The physical characterization method for a large-scale natural gas hydrate experimental system, using any one physical characterization device as described above, comprises the following steps:

dividing sediment in the chamber of the reactor into a plurality of layers;

arranging the lateral vertical well assemblies 19 and the temperature-pressure-resistance assemblies 20 in the matrix array, and inserting the lateral vertical well assemblies 19 and the temperature-pressure-resistance assemblies 20 longitudinally into the reactor;

producing contour plots using a data processing software with three-dimensional matrix data collected by the pressure measuring tubes 6, the temperature measuring tubes 7, and the resistivity measuring columns 5, for real-time inspecting a temperature field, a pressure field, and a resistivity filed in the reactor, and thereby simulating a distribution field, a pressure field, and a temperature field of hydrates in the reactor.

Furthermore, the chamber of the reactor is a cylinder with a height of 1680 mm and a diameter of 1400 mm, and the sediment in the chamber is divided into five layers, respectively with a distance of 160 mm, 500 mm, 840 mm, 1180 mm, and 1520 mm from a top of the reservoir.

Furthermore, the matrix array is a 900 mm×900 mm rectangular plane centered on an axis of the reactor, and a distance between each two adjacent assemblies is 150 mm.

Formation, analysis, and application of the temperature field, pressure field, and hydrate distribution field: The step of producing the contour plots using a data processing software with the three-dimensional matrix data collected by the pressure/temperature/resistivity sensors, allows to real-time inspect a temperature field, a pressure field, and a resistivity filed in the reactor of a large-scale experimental system. Since the resistivity relates to the formation and dissociation of hydrates, hydrate field can be defined by the resistivity filed, thereby allowing visually simulation of the distribution field, the pressure field, and the temperature field of hydrates in the reactor.

The above-mentioned embodiments are only intended to illustrate the technical concept and characteristics of the present invention, enabling those of ordinary skill in the art to understand the content of the present invention and implement them accordingly, but are not intended to limit the scope of the present invention. All equivalent changes or modifications made according to the essence of the present invention should fall within the scope of the present invention.

What is claimed is:

1. A physical characterization device for a large-scale natural gas hydrate experimental system, comprising a reactor, horizontal wellbores, and vertical wellbores, wherein the reactor comprises an upper cover, a lower cover, and a reactor body, and the upper cover and the lower cover are sealably attached to two ends of the reactor body to form a closed chamber, wherein the closed chamber is filled with a porous medium and a liquid, and the porous medium and the liquid is configured to simulate a geologically layered structure of a hydrate reservoir;

the physical characterization device further comprises lateral vertical well assemblies and temperature-pressure-resistance assemblies, wherein the lateral vertical well assemblies and the temperature-pressure-resistance assemblies are disposed to penetrate the reactor from the upper cover to the lower cover;

each of the lateral vertical well assemblies and the temperature-pressure-resistance assemblies comprises a mounting pipe, a sealing plug, a lock nut, resistivity measuring columns, pressure measuring tubes, and temperature measuring tubes;

the mounting pipe is connected to the upper cover;

the sealing plug is sealingly inserted into a top end of the mounting pipe and the sealing plug is secured by the lock nut;

the resistivity measuring columns, the pressure measuring tubes, and the temperature measuring tubes are disposed in parallel to each other to penetrate the sealing plug and extend along an axial direction of the mounting pipe;

a pressure probe is provided at a bottom end of each of the pressure measuring tubes and a temperature probe is provided at a bottom end of each of the temperature measuring tubes;

the each of the lateral vertical well assemblies is further provided with the vertical wellbores, wherein the vertical wellbores are disposed in parallel to the resistivity measuring columns, the pressure measuring tubes, and the temperature measuring tubes, and a sand screen is provided at a bottom end of each of the vertical wellbores;

the horizontal wellbores are inserted into the reactor in a direction perpendicular to the vertical wellbores; and the lateral vertical well assemblies and the temperature-pressure-resistance assemblies are configured to collect temperature data, pressure data, and resistivity data for characterizing the geologically layered structure of the hydrate reservoir in the reactor.

2. The physical characterization device according to claim 1, wherein a resistivity measuring column support is provided inside the each of the lateral vertical well assemblies, wherein an upper end of the resistivity measuring column support is fixed to the sealing plug; and a plurality of clips are provided on the resistivity measuring column support along an axial direction of the resistivity measuring column support, and the plurality of clips are configured to secure the resistivity measuring columns.

3. The physical characterization device according to claim 1, wherein the lateral vertical well assemblies and the temperature-pressure-resistance assemblies are disposed in a 9×9 matrix array, wherein the lateral vertical well assemblies are disposed in three rows in the 9×9 matrix array, three lateral vertical well assemblies of the lateral vertical well assemblies are disposed at regular intervals in each row of the three rows, and two temperature-pressure-resistance assemblies of the temperature-pressure-resistance assemblies are disposed at regular intervals between each two lateral vertical well assemblies.

4. The physical characterization device according to claim 3, wherein the each of the lateral vertical well assemblies and the temperature-pressure-resistance assemblies comprises five resistivity measuring columns, five pressure measuring tubes, and five temperature measuring tubes; and the 9×9 matrix array is a 900 mm×900 mm rectangular plane centered on an axis of the reactor, and a distance between each two adjacent assemblies of the lateral vertical well assemblies and the temperature-pressure-resistance assemblies is 150 mm.

5. The physical characterization device according to claim 3, wherein a vertical wellbore located at a center of the reactor is a central vertical wellbore, and remaining vertical wellbores are non-central vertical wellbores, wherein pressure sensors of the pressure measuring tubes in the central vertical wellbore are central vertical well pressure sensors, and pressure sensors of the pressure measuring tubes in the non-central vertical wellbores are non-central vertical well pressure sensors;

the physical characterization device further comprises non-central vertical well outlet valves, communicating vessel valves, differential pressure sensors, a communicating vessel, and a central vertical well outlet valve; wherein the non-central vertical well pressure sensors, the non-central vertical well outlet valves, the differential pressure sensors, and the communicating vessel valves are respectively provided in an amount identical to an amount of the non-central vertical wellbores;

each of the non-central vertical wellbores is provided with a non-central vertical well outlet pipeline, wherein the non-central vertical well outlet pipeline is correspondingly provided with one of the non-central vertical well pressure sensors, one of the non-central vertical well outlet valves, one of the differential pressure sensors, and one of the communicating vessel valves communicatedly in sequence, and all of the communicating vessel valves are connected with the communicating vessel; and the central vertical wellbore is provided with a central vertical well outlet pipeline, wherein the central vertical well outlet pipeline is provided with the central vertical well pressure sensors and the central vertical well outlet valve communicatedly in sequence, and the central vertical well outlet valve is connected with the communicating vessel.

6. The physical characterization device according to claim 5, wherein the differential pressure sensors and the communicating vessel are disposed outside the reactor; and the differential pressure sensors have a measuring accuracy higher than a measuring accuracy of the central vertical well pressure sensors and a measuring accuracy of the non-central vertical well pressure sensors, and a measuring range lower than a measuring range of the central vertical well pressure sensors and a measuring range the non-central vertical well pressure sensors.

7. The physical characterization device according to claim 1, wherein the each of the pressure measuring tubes is sprayed with a thermally and electrically insulating coating and the each of the pressure measuring tubes is subjected to surface roughening; and the each of the temperature measuring tubes is a stainless steel tube and subjected to the surface roughening.

8. A physical characterization method for a large-scale natural gas hydrate experimental system, using the physical characterization device of claim 1, comprising the following steps:

dividing a sediment in the closed chamber of the reactor into a plurality of layers;

arranging the lateral vertical well assemblies and the temperature-pressure-resistance assemblies in a 9×9 matrix array, and inserting the lateral vertical well assemblies and the temperature-pressure-resistance assemblies longitudinally into the reactor;

producing contour plots using a data processing software with three-dimensional matrix data collected by the pressure measuring tubes, the temperature measuring tubes, and the resistivity measuring columns, for real-time inspecting a temperature field, a pressure field, and a resistivity filed in the reactor, and simulating a hydrate distribution field, the pressure field, and the temperature field in the reactor.

9. The physical characterization method according to claim 8, wherein the closed chamber of the reactor is a cylinder with a height of 1680 mm and a diameter of 1400 mm, and the sediment in the closed chamber is divided into five layers, respectively with a distance of 160 mm, 500 mm, 840 mm, 1180 mm, and 1520 mm from a top of the hydrate reservoir.

10. The physical characterization method according to claim 8, wherein the 9×9 matrix array is a 900 mm×900 mm rectangular plane centered on an axis of the reactor, and a distance between each two adjacent assemblies of the lateral vertical well assemblies and the temperature-pressure-resistance assemblies is 150 mm.

* * * * *